United States Patent [19]

Lundquist

[11] Patent Number: 4,684,172

[45] Date of Patent: Aug. 4, 1987

[54] SEATING UNIT AND GANGING CONNECTOR FOR RELEASABLY INTERCONNECTING A PLURALITY OF INDIVIDUAL FURNITURE UNITS SUCH AS CHAIRS

[76] Inventor: Roy D. Lundquist, Rte. 1, Luck, Wis. 54853

[21] Appl. No.: 873,516

[22] Filed: Jun. 12, 1986

[51] Int. Cl.[4] ..... A47C 15/00

[52] U.S. Cl. ..... 297/248

[58] Field of Search ..... 297/248; 403/388, 393; 24/457, 458, 573, 453; 52/585; 248/302; 108/64; 292/238; 182/204

[56] References Cited

U.S. PATENT DOCUMENTS

| | | | |
|---|---|---|---|
| 1,560,978 | 11/1925 | Crump | 182/204 |
| 3,669,491 | 6/1972 | Weslock | 297/248 |
| 3,827,749 | 8/1974 | Johnson et al. | 297/264 |
| 4,579,478 | 4/1986 | Takahashi | 24/453 |

*Primary Examiner*—James T. McCall

*Attorney, Agent, or Firm*—Warren A. Sturm

[57] ABSTRACT

A ganging system and connector for assembling a plurality of like, furniture elements such as stackable individual chairs into a stable, unitary, row of seats for use in an auditorium or the like. A stylized "G"-shaped connector extends through apertures coaxially disposed in the side leg members of adjacent chairs and releasably, lockably connects adjacent chairs to form a unitary structure.

10 Claims, 7 Drawing Figures

SEATING UNIT AND GANGING CONNECTOR FOR RELEASABLY INTERCONNECTING A PLURALITY OF INDIVIDUAL FURNITURE UNITS SUCH AS CHAIRS

BACKGROUND OF THE INVENTION

1. Field of the Invention

My invention relates generally to the provision of rows of furniture elements or units such as seats through the assembly of individual furniture units such as chairs into a contiguous furniture units to provide, for example, a seating unit comprised of a plurality of furniture units such as chairs that are releasably interconnected to form a rigid permanent row of chairs that may be moved as a unit, or disassembled to individual furniture units such as chairs as required by the occasion.

2. Prior Art

A review of the prior art has disclosed the existence of a plurality of various and sundry arrangements to provide for the ganging interlocking assembly of individual furniture units such as chairs into rows.

One example may be seen in the recent U.S. Pat. No. 4,400,031 issued Aug. 23, 1983 to Edward J. DeDecker for INTERLOCKING CHAIR. In the DeDecker patent, chairs are provided with a sidewardly extending bar on one chair that is configured to be inserted into a sidewardly opening socket on another, adjacent chair, rendering the assemblage and/or the chair itself unduly complicated and unsightly from an aesthetic standpoint.

Another less recent illustration of the prior art is seen in the Mehr et al U.S. Pat. No. 3,614,158 issued Oct. 19, 1971 for CHAIR GANGING DEVICE which illustrates a retractable ganging arrangement that is complex and not particularly suited to maintaining a row of chairs in precise alignment.

An earlier illustration may be seen in the Huntley U.S. Pat. No. 1,198,726 issued Sept. 19, 1916 for SEAT COUPLING. The Huntley patent, again, provides a complex structure that is not particularly well suited for maintaining a precise alignment and cannot provide its function without the presence of additional elements mounted upon, or forming a part of, the chair itself.

Other examples may be seen in the following list of Prior Art patents noted in the course of preliminary search on the invention of this application, none of which are believed to be particularly relevant to my invention:

| Patent No. | Patentee | Issue Date |
|---|---|---|
| 4,400,031 | E. J. DeDecker | August 23, 1983 |
| 3,697,130 | Barecki et al | October 10, 1972 |
| 3,695,694 | R. G. Mohr | October 3, 1972 |
| 3,614,158 | R. G. Mohr | October 19, 1971 |
| 3,278,227 | D. L. Rowland | October 11, 1966 |
| 3,159,425 | C. J. Engstrom | December 1, 1964 |
| 3,133,762 | W. R. Newman | May 19, 1964 |
| 3,053,493 | J. N. Stafford | September 11, 1962 |
| 1,198,726 | G. M. Huntley | September 19, 1916 |

BRIEF DESCRIPTION OF THE INVENTION

My invention comprises a unique, uncomplicated connector that may be used with variety of types of furniture units such as chairs of the class having side portions having at least two spaced apart portions lying in a common plane and in which the common planes defined thereby, as they exist in a pair of chairs, positioned in adjacent, side-by-side, relationship. My invention contemplates the provision of a pair of apertures extending perpendicularly to the planes of the two outside portions of furniture units such as the sides of the chairs into which one portion of my connector is inserted, while another portion may be allowed to engage, as by the force of gravity, the edges of the insides of the portions of the chairs to provide a releasable locking engagement The apertures are so dimensioned, with respect to the insertable portion of the connector that a rigid interlocking connection is effected and the number of furniture units or chairs so connected in a row may be considered to be limitless unless one desires to pick up the assemblage as a unit, at which point practical considerations such as the weight of the assemblage and/or the strenth of the side members of the furniture units or chairs may present somewhat limiting factors.

It is an object of my invention to provide a seating system in which individual furniture units or chairs exhibiting a typical side frame characteristic may be interconnected and handled as a seating unit by virtue of a vastly less complicated connector that provides an improved stability of connection and may be easily removed for separation of groups or individual chairs from a seating unit.

Other forms of devices and apparatus that may be used in practicing the principles of my invention may become apparent from a consideration of the appended specification, claims and drawing in which:

Figure 1:
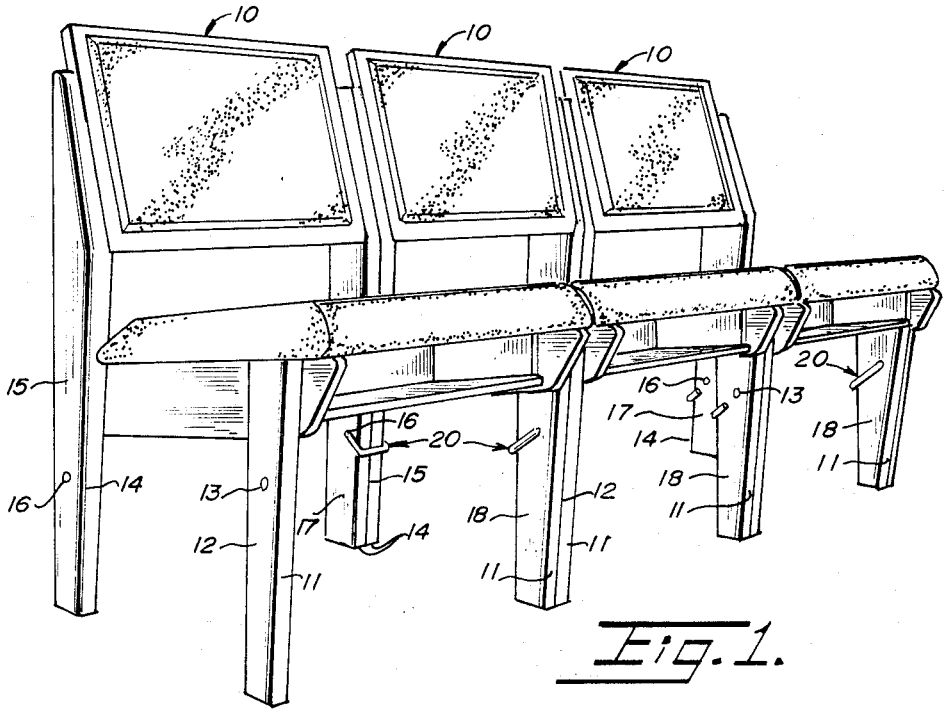
FIG. 1 is a perspective sketch of an assemblage of chairs into a seating unit embodying the principles of my invention.
Figure 2:
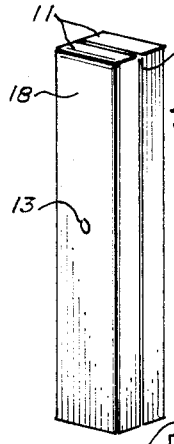
FIGS. 2, 3 and 4 are perspective sketches illustrating the operation of a connector as utilized in FIG. 1.
Figure 3:
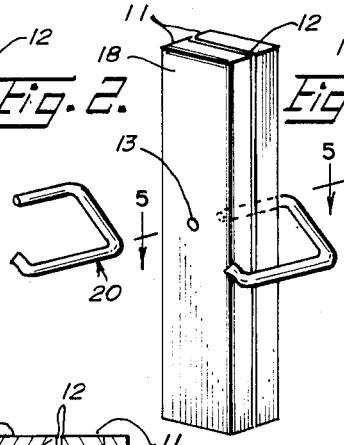

Referring to the drawings, in which like elements are identified with like reference characters, a plurality of chairs, 10, are illustrated in whole and in part as being interconnected by a plurality of connectors 20 extending through and intermediate predetermined side frame portions of the individual chairs.

For the purposes of describing my invention, the furniture units or individual chairs, 10, are shown with each provided with a pair of front legs 11, having an outside side planar surface 12, inside planar surfaces 17 and an aperture, 13, extending laterally therethrough; and a pair of back legs 14, each having outside planar surfaces 15, inside planar surfaces 17 and an aperture, or hole, 16, extending laterally therethrough. Apertures 13 in front legs 11 and apertures 16 in back legs 14 may be seen to be disposed for coaxial alignment when a plurality of chairs, 10, are aligned in a row to form an interconnected, rigid, stable seating unit.

The illustrated chairs, 10, are of the class that may conveniently be stored and transported in vertical stacks of individual chairs after removal of the connectors in a seating group.

In the illustrated preferred embodiment, the front and back legs 11 and 14 are shown in the drawings as exhibiting a planar surface. While this form of design may exhibit an improved stability when chairs 10 are assembled into a seating unit, it is anticipated that the surface areas 12 and 15, surrounding apertures 13 and 16 in front and back legs 11 and 14 respectively, will lie in a common plane, typically a plane that is disposed vertically in the outer facing side portions of individual chairs, 10.

Figure 7:
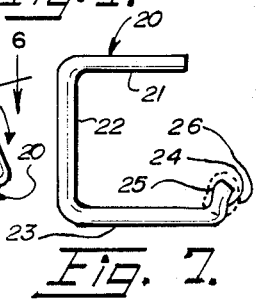
FIG. 7 is a plan view of the connector shown in various locations in FIGS. 1–6.

Referring to FIG. 7, a connector 20 is shown comprised of interconnected leg portions 21, 22, 23, and 24. Connector 20 is preferably comprised of rigid round material that is dimensioned so that leg 21 may be slidably, frictionally disposed in apertures 13 and 16, as illustrated in the sectional views of FIGS. 5 and 6. Legs 21 and 23 are shown in substantial parallel relationship and are interconnected by leg 22. Leg 22 and leg 24 are similarly in substantially parallel relationship and when in the installed position of connecting the side portions of a pair of chairs, 10, may be seen to engage the inwardly facing surfaces 17 and 18 of front and back chair legs 11 and 14. Leg 24 is relatively short and terminates with an 25 that is preferably angled outwardly away from leg 22 in order to facilitate the operation of connector 20. The extreme end portion of leg 24 may be coated with a suitable resilient material 26, shown in phantom outline in FIG. 7, for increasing the frictional engagement of the inner edge of leg 24 with the inner surface of legs 11 and 14 on chair 10. It may be noted at this point that the longitudinal dimension of leg 21 is equal to or less than the total thickness of front and back legs 11 and 14 as illustrated on FIGS. 5 and 6 of the drawings. Similarly, the longitudinal length of leg 23 is such that the inner edges or sides of legs 22 and 24 are spaced apart by a distance substantially equal to or slightly more than the combined thickness of front and back legs 11 and 14 on chair 10. The length of leg 22 is such that legs 21 and 23 are separated by a distance greater than the distance of apertures 13 and 16 from the front or back of legs 11 and 15.

In one embodiment of my invention, connectors 20 were fabricated of one-quarter inch steel rod and apertures 13 and 16 in front and back legs 11 and 14 on chair 10, were slightly more than one-fourth inch in diameter.

Operation

Figure 4:
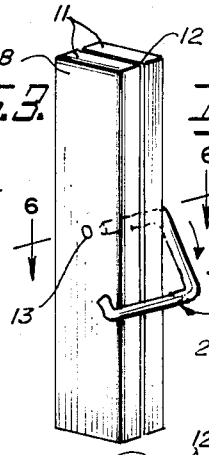
Figure 5:
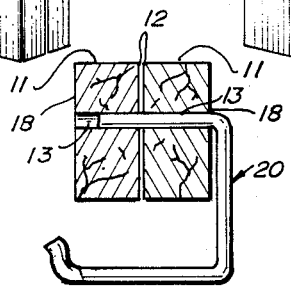
FIG. 5 is a sectional line taken along section line 5—5 of FIG. 3 of the drawings.
Figure 6:
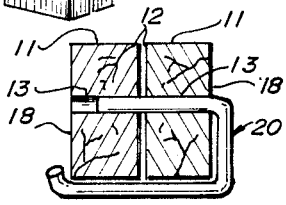
FIG. 6 is a sectional view taken along section line 6—6 of FIG. 4.

When it is desired to create an assemblage, or set, of a plurality of furniture units or chairs 10, the chairs are placed in aligned side-by-side relationship, as illustrated in FIG. 1 of the drawings, so that front legs 11 and back legs 14 are in side-by-side adjacent disposition and apertures 13 and 16 are in coaxial alignment. Leg 21 of connector 20 is then placed in a substantially horizontal position and the clearance intermediate end 25 of leg 24 permits an easy insertion of leg 21 into the aligned apertures at each pair of adjacent chair leg members so that the position indicated in FIG. 5 is obtained with leg 22 adjacent the inner surface 18 of a chair leg 11 and leg 21 extends through apertures 13 into the next adjacently disposed chair leg 11. Connector 20 may be released and will fall, under the force of gravity, to position indicated in FIGS. 4 and 6 whereat leg 24 engages the inside surface of chair leg 11 with the inclined portion 25 and thereafter the remainder of leg 24 and leg 22 in engagement with the inside surface 18 of the other chair leg 11 so as to present a rigid, stable connection. Disconnecting the chairs requires a reverse procedure and is initiated by engaging leg 23 and raising connector 20 to a substantially horizontal position and then withdrawing leg 21 from aperture 13.

Dependent upon the nature of the materials utilized for the chair legs and connector 20, apertures 13 and 16 may be of slightly larger diameter than the diameter of the material of which connectors 20 are comprised. A soft resilient coating, or tip 26, on the end of may also be provided to effect a coupling that will absorb shock and the like as might be occasioned by use of a seating assemblage.

I claim:

1. In combination with a pair of furniture units, each having side members with inner side surfaces and substantially planar outer side surfaces, disposed in adjacent side-by-side relationship;

at least a pair of laterally spaced apertures extending through said side members and surfaces and an coaxial alignment; and single, rigid connecting means extending through both of said apertures, said connecting means including means for releasably engaging the inside of the side surface of each furniture unit opposite said adjacent outer side surfaces whereby said furniture units are maintained in triaxial rigid disposition.

2. The subject matter of claim 1 in which the chairs are configured to provide vertical stacking of each of the chair units.

3. The subject matter of claim 1 in which the connecting means includes a first leg dimensioned to be slidably received in the laterally spaced apertures.

4. The subject matter of claim 3 in which the means for releasably engaging the inside of the side of each chair opposite the adjacent outer side surfaces is dimensioned substantially equal to the thickness of the sides of the chairs adjacent the apertures.

5. The subject matter of claim 1 in which the connecting means is comprised of first, second, third and fourth legs, said first leg dimensioned to be slidably received in the apertures, said first and third legs being disposed in parallel spaced-apart relationship and interconnected by a second leg extending intermediate corresponding ends and a fourth leg disposed parallel to said second leg, and depending toward said first leg from the other end of said third leg.

6. The subject matter of claim 5 in which the first leg of the connecting means is equal to or less than the combined thickness of the side members of a chair.

7. The subject matter of claim 5 in which the longitudinal length of the third leg is substantially equal to the combined thickness of the side members.

8. The subject matter of claim 5 in which the end of the fourth leg is spaced from the first leg a distance greater than the distance from an aperture to the front or rear edges of a side-member.

9. The subject matter of claim 8 in which the end of the fourth leg is inclined at an angle extending away from the longitudinal axis of the second leg.

10. The subject matter of claim 1 in which the connecting means is comprised a generally "G"-shaped configuration in which the top end is straight, and extends into the apertures in the sides of the chairs, and the vertical sides are in engagement with the inside of the side of each chair opposite the adjacent outer side surfaces.

* * * * *